US009090098B2

(12) United States Patent
Samoto et al.

(10) Patent No.: US 9,090,098 B2
(45) Date of Patent: Jul. 28, 2015

(54) IMAGE RECORDING APPARATUS

(71) Applicant: BROTHER KOGYO KABUSHIKI KAISHA, Nagoya (JP)

(72) Inventors: Kenji Samoto, Nagoya (JP); Yuji Koga, Nagoya (JP); Takashi Omura, Nagoya (JP)

(73) Assignee: BROTHER KOGYO KABUSHIKI KAISHA, Nagoya-Shi, Aichi-Ken (JP)

( * ) Notice: Subject to any disclaimer, the term of this patent is extended or adjusted under 35 U.S.C. 154(b) by 0 days.

(21) Appl. No.: 13/851,719

(22) Filed: Mar. 27, 2013

(65) Prior Publication Data

US 2013/0256984 A1 Oct. 3, 2013

(30) Foreign Application Priority Data

Mar. 27, 2012 (JP) ..... 2012-070615

(51) Int. Cl.
*B65H 5/22* (2006.01)
*B65H 83/00* (2006.01)
(Continued)

(52) U.S. Cl.
CPC .. *B41J 13/00* (2013.01); *B41J 3/60* (2013.01); *B41J 13/10* (2013.01); *B65H 83/00* (2013.01); *B65H 85/00* (2013.01)
USPC ..... 271/3.14; 271/3.19; 271/3.2; 271/291; 271/301

(58) Field of Classification Search
CPC ..... B65H 31/02; B65H 5/062; B65H 2301/42146; B65H 27/00; B65H 83/00; B65H 85/00; B41J 11/007; B41J 11/06; B41J 11/0085; B41J 13/103; B41J 11/0065; B41J 13/00; B41J 3/60; B41J 13/10; G03G 15/60; G03G 2215/00185; G03G 15/23; G03B 27/6257; G03B 27/6264
USPC ..... 271/3.14, 3.19, 3.2, 291, 301, 65
See application file for complete search history.

(56) References Cited

U.S. PATENT DOCUMENTS 5,513,840 A 5/1996 Fujita et al.
5,874,979 A 2/1999 Ohyama
(Continued)

FOREIGN PATENT DOCUMENTS

JP 5-155497 A 6/1993
JP 9-048161 A 2/1997
(Continued)

OTHER PUBLICATIONS

Japanese Office Action issued in JP 2012-070615, mailed Aug. 19, 2014.

*Primary Examiner* — David H Bollinger
(74) *Attorney, Agent, or Firm* — Merchant & Gould PC

(57) ABSTRACT

An image recording apparatus includes a first upper-position guide member, a first lower-position guide member defining a first feeding path and a first feeding portion feeding a sheet in a feeding direction along the first feeding path. The image recording apparatus further includes a recording portion located downstream of the first feeding portion in the feeding direction, a second upper-position guide member, a second lower-position guide member defining a second feeding path and a second feeding portion comprising at least one pair of rollers each consisting of an upper-position roller and a lower-position roller. The second feeding portion feeds the sheet along the second feeding path and a first axis of the upper-position roller is located upstream of a second axis of the lower-position roller in the feeding direction.

6 Claims, 8 Drawing Sheets

(51) Int. Cl.

| | |
|---|---|
| ***B65H 85/00*** | (2006.01) |
| ***B41J 13/00*** | (2006.01) |
| ***B41J 3/60*** | (2006.01) |
| ***B41J 13/10*** | (2006.01) |

(56) References Cited

U.S. PATENT DOCUMENTS

| | | | | |
|---|---|---|---|---|
| 8,152,169 | B2 * | 4/2012 | Samoto et al. | 271/301 |
| 8,493,639 | B2 * | 7/2013 | Samoto et al. | 358/498 |
| 2006/0279622 | A1 * | 12/2006 | Kao | 347/104 |
| 2010/0207321 | A1 | 8/2010 | Samoto et al. | |
| 2010/0314822 | A1 * | 12/2010 | Tsao | 271/3.14 |
| 2011/0157664 | A1 * | 6/2011 | Samoto et al. | 358/498 |
| 2011/0291347 | A1 * | 12/2011 | Sano et al. | 271/3.19 |
| 2011/0309564 | A1 * | 12/2011 | Samoto et al. | 271/3.19 |
| 2011/0310207 | A1 * | 12/2011 | Ito et al. | 347/104 |
| 2011/0311294 | A1 | 12/2011 | Kawamata et al. | |
| 2012/0161380 | A1 * | 6/2012 | Iijima | 271/3.19 |
| 2012/0161387 | A1 * | 6/2012 | Horade | 271/225 |
| 2012/0188321 | A1 * | 7/2012 | Iijima et al. | 347/104 |
| 2012/0228816 | A1 * | 9/2012 | Tomatsu | 271/3.19 |
| 2013/0140764 | A1 * | 6/2013 | Samoto et al. | 271/225 |

FOREIGN PATENT DOCUMENTS

| | | | |
|---|---|---|---|
| JP | H11-227978 | A | 8/1999 |
| JP | 2010-208853 | A | 9/2010 |
| JP | 2010-269455 | A | 12/2010 |
| JP | 2012-000872 | A | 1/2012 |

* cited by examiner

IMAGE RECORDING APPARATUS

CROSS REFERENCE TO RELATED APPLICATION

The present application claims priority from Japanese Patent Application No. 2012-070615, which was filed on Mar. 27, 2012, the disclosure of which is herein incorporated by reference to its entirety.

BACKGROUND OF THE INVENTION

1. Field of the Invention

The present invention relates to an image recording apparatus which records an image on a sheet, especially an image recording apparatus capable of recording images on both faces of the sheet.

2. Description of Related Art

There is known an image recording apparatus which can record images on both faces of a sheet. The image recording apparatus comprises a main feeding path to feed the sheet on which an image is recorded by a recording portion from a supply tray on which the sheet is placed to a discharge opening. The image recording apparatus further comprises a resupply feeding path. The resupply feeding path is a feeding path to resupply the sheet on which an image has been recorded on a front face by the recording portion. The resupply feeding path extends from a downstream side of the recording portion to an upstream side of the recording portion in the main feeding path. The sheet fed through the resupply feeding path reaches the recording portion in a state in which a back face of the sheet is opposed to the recording portion. Accordingly, the recording portion can record an image on the back face of the sheet.

In the above-mentioned image recording apparatus, the sheet needs to be fed to the resupply feeding path when an image has been recorded only on the front face thereof and an image is not yet recorded on the back face thereof. On the other hand, the sheet which images have been recorded on both faces thereof needs to be fed to not the resupply feeding path but the discharge opening so as to be discharged from the apparatus. In other words, a path-switching portion needs to be provided in order to switch a destination where the sheet is fed after the image recording.

There is known an image recording apparatus including a flap as the path-switching portion. In the image recording apparatus, the flap is pivotably supported, and the flap is usually pivoted downward under its weight, but is pushed upward by the sheet being fed in a feeding path.

SUMMARY OF THE INVENTION

However, the flap configured to be pivoted under its weight as mentioned above needs to have a structure of a large size to some extent. Therefore, in order to dispose such a flap in the apparatus, a large space in the apparatus is necessary. Although downsizing of an image recording apparatus is required in recent years, the image recording apparatus having the above-mentioned flap for the double-face printing prevents the downsizing of the apparatus.

It is therefore an object of the present invention to provide an image recording apparatus capable of feeding the sheet to the resupply feeding path without the path-switching portion for switching a destination of the sheet between the main feeding path and the resupply feeding path.

In order to achieve the above-mentioned object, according to the present invention, there is provided an image recording apparatus comprising: a first upper-position guide member and a first lower-position guide member opposed to each other and defining a first feeding path; a first feeding portion configured to feed a sheet in a feeding direction along the first feeding path; a recording portion located downstream of the first feeding portion in the feeding direction and configured to record an image on the sheet fed in the first feeding path; a second upper-position guide member and a second lower-position guide member opposed to each other and defining a second feeding path which is connected to the first feeding path at a downstream position of the recording portion in the feeding direction and extends obliquely downward from a connecting position where the second feeding path connects to the first feeding path so as to pass below the recording portion; and a second feeding portion comprising at least one pair of rollers each consisting of an upper-position roller and a lower-position roller which is located downstream of the connecting position in the feeding direction, wherein the second feeding portion is configured to feed the sheet along the second feeding path, and a first axis of the upper-position roller is located upstream of a second axis of the lower-position roller in the feeding direction.

BRIEF DESCRIPTION OF THE DRAWINGS

The above and other objects, features, advantages and technical and industrial significance of the present invention will be better understood by reading the following detailed description of a preferred embodiment of the invention, when considered in connection with the accompanying drawings, in which.

DETAILED DESCRIPTION OF THE PREFERRED EMBODIMENTS

Hereinafter, there will be described a Multifunction Device (MFD) 10 as one embodiment of an image recording apparatus to which the present invention is applied. The present invention is not limited to the illustrated embodiment. It is to be understood that the present invention may be embodied with various changes and modifications that may occur to a person skilled in the art, without departing from the spirit and scope of the invention defined in the appended claims. Further, hereinafter, an orientation going from a starting point of an arrow to an ending point thereof is referred to as a direction, and orientations coming and going (reciprocations) on a line connecting between the starting point and the ending point of the arrow are referred to as directions. Furthermore, hereinafter, based on a state in which the MFD 10 is installed in use (a state shown in FIG. 1), up-down directions 7 are defined, front-rear directions 8 are defined as a portion in which an opening 13 is formed is a near portion (a front portion of the MFD 10), and left-right directions 9 are defined as the MFD 10 is seen from the front portion.

Overall Structure of MFD 10

Figure 1:
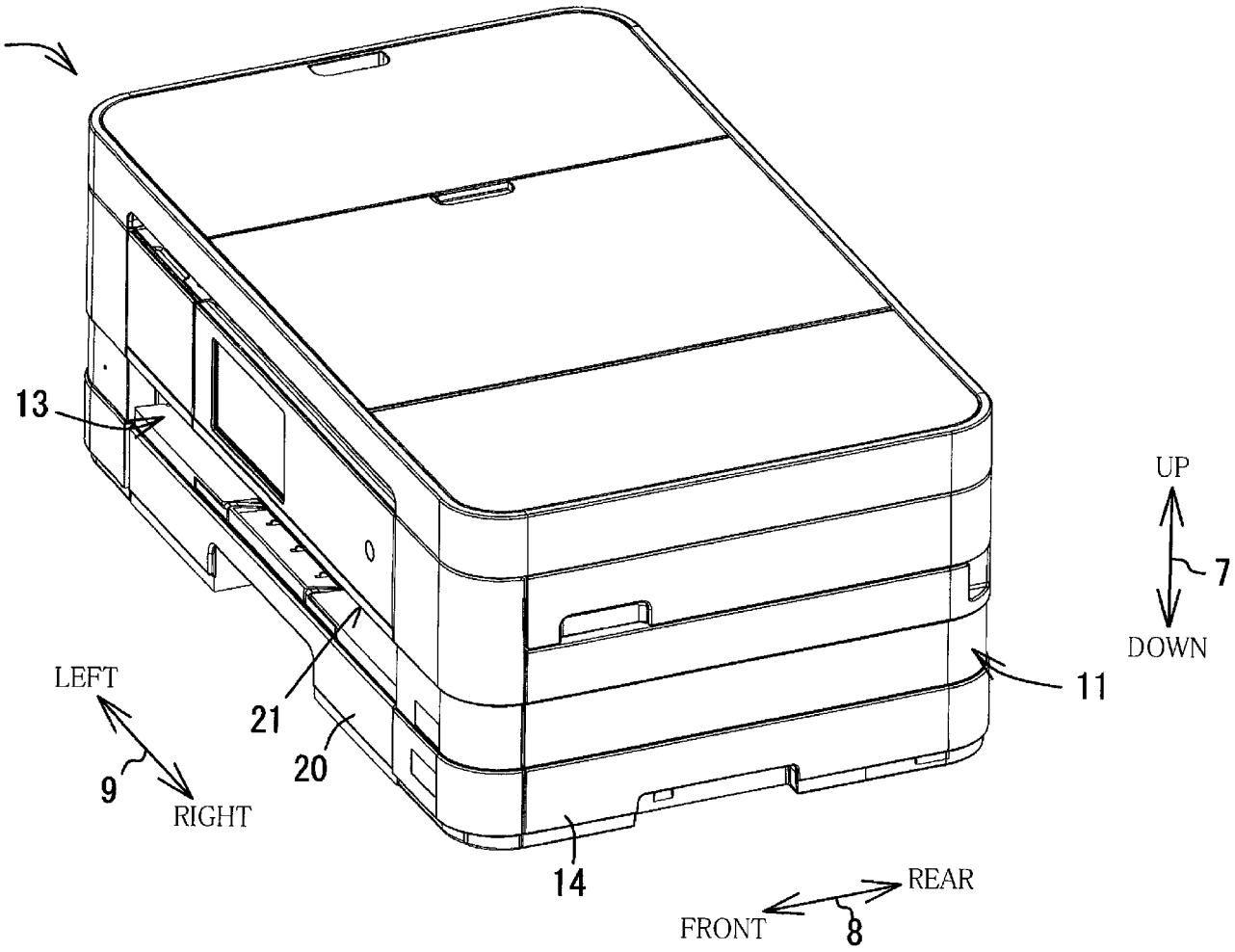
FIG. 1 is a perspective view showing a Multifunction Device (MFD) as one embodiment to which the present invention is applied.

As shown in FIG. 1, the MFD 10 as an example of the image recording apparatus has a generally rectangular parallelepiped shape and includes a printer portion 11 in a lower portion thereof. The MFD 10 includes a casing 14 having the opening 13 formed in the front portion thereof. A sheet-supply tray 20 is attachable to and detachable from the opening 13 in the front-rear directions 8. In the sheet-supply tray 20, recording sheets 12 (an example of a sheet) of a desired size such as A4-size, B5-size or the like are placed. In the present embodiment, a front portion above the sheet-supply tray 20 is covered by a sheet-discharge tray 21 (shown in FIG. 2).

Figure 2:
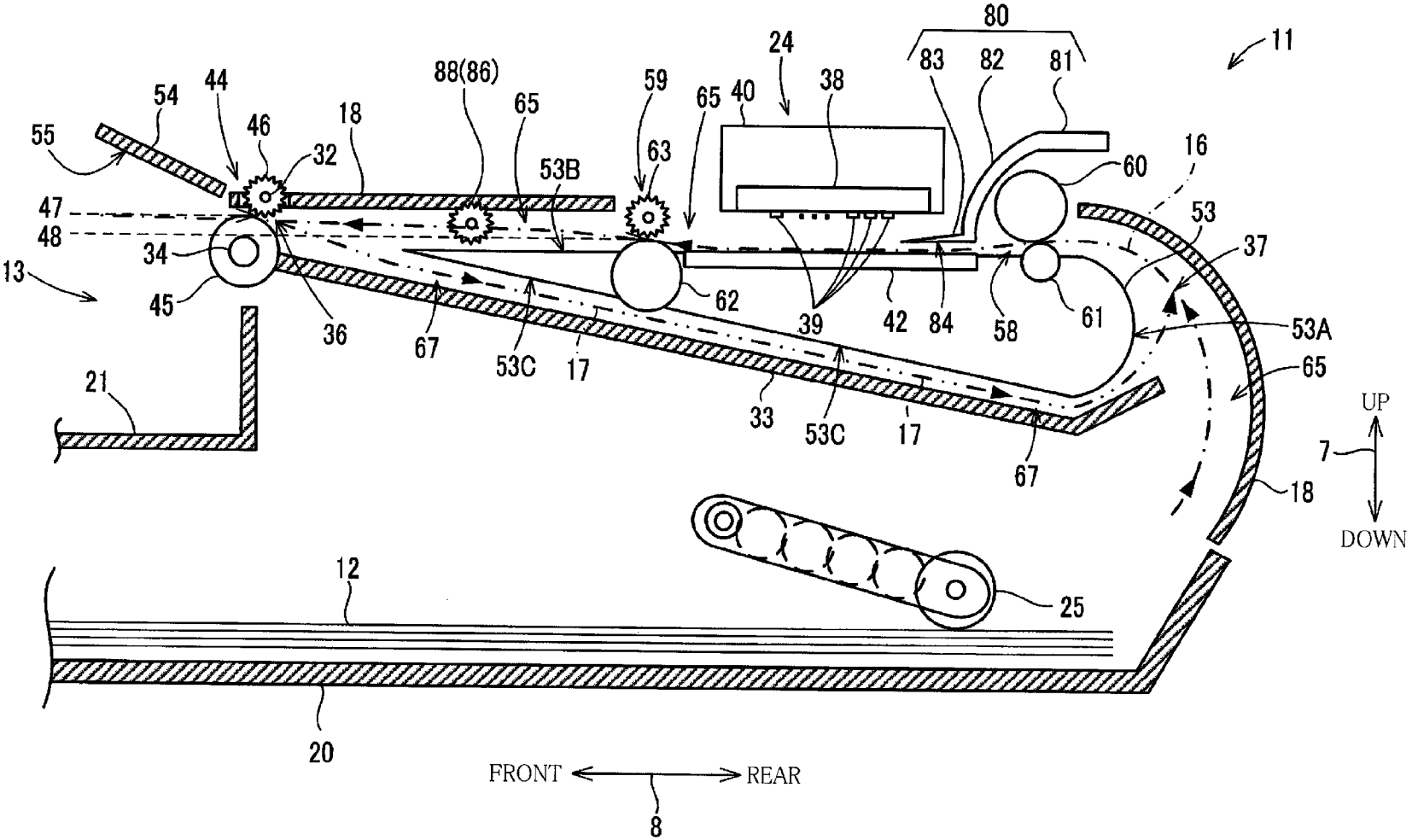
FIG. 2 is a cross-sectional view schematically showing an internal structure of a printer portion of the MFD.

As shown in FIG. 2, the printer portion 11 includes a sheet-supply roller 25 which supplies the recording sheet 12 placed in the sheet-supply tray 20, an inkjet recording portion 24 (an example of a recording portion) which records an image on the recording sheet 12, and so forth.

The sheet-supply roller 25 is disposed above the sheet-supply tray 20. The sheet-supply roller 25 is rotated by a drive power transmitted from a sheet-supply motor (not shown). Thus, the recording sheet 12 placed in the sheet-supply tray 20 is supplied to a feeding path 65 (an example of a first conveying path).

In the MFD 10, there is formed the feeding path 65. The feeding path 65 consists of a curved portion which extends upward and frontward in a curved manner from a rear end portion of the sheet-supply tray 20, and a straight portion which connects to the curved portion and passes below the recording portion 24 and extends to the sheet-discharge tray 21. The feeding path 65 is defined by an outer-position guide member 18 (an example of a first upper-position guide member) and an inner-position guide member 53 (to be more specific, a curved surface 53A and an upper surface 53B of the inner-position guide member 53) which are opposed to each other at a certain interval. The curved surface 53A and the upper surface 53B of the inner-position guide member 53 are an example of a first lower-position guide member. The outer-position guide member 18, the inner-position guide member 53, and the lower-position guide member 33 described later extend in a direction perpendicular to a sheet plane of FIG. 2, i.e., in the left-right directions 9.

The recording sheet 12 accommodated in the sheet-supply tray 20 is fed in a U-turn manner from a lower portion to an upper portion through the curved portion of the feeding path 65 and then fed through the straight portion of the feeding path 65 to the recording portion 24. The recording sheet 12 on which an image has been recorded by the recording portion 24 is fed through the straight portion and discharged onto the sheet-discharge tray 21. In other words, the recording sheet 12 is fed in a first direction (an example of a feeding direction) along the feeding path 65, which is indicated by a one-dot chain line arrow in FIG. 2.

Figure 6:
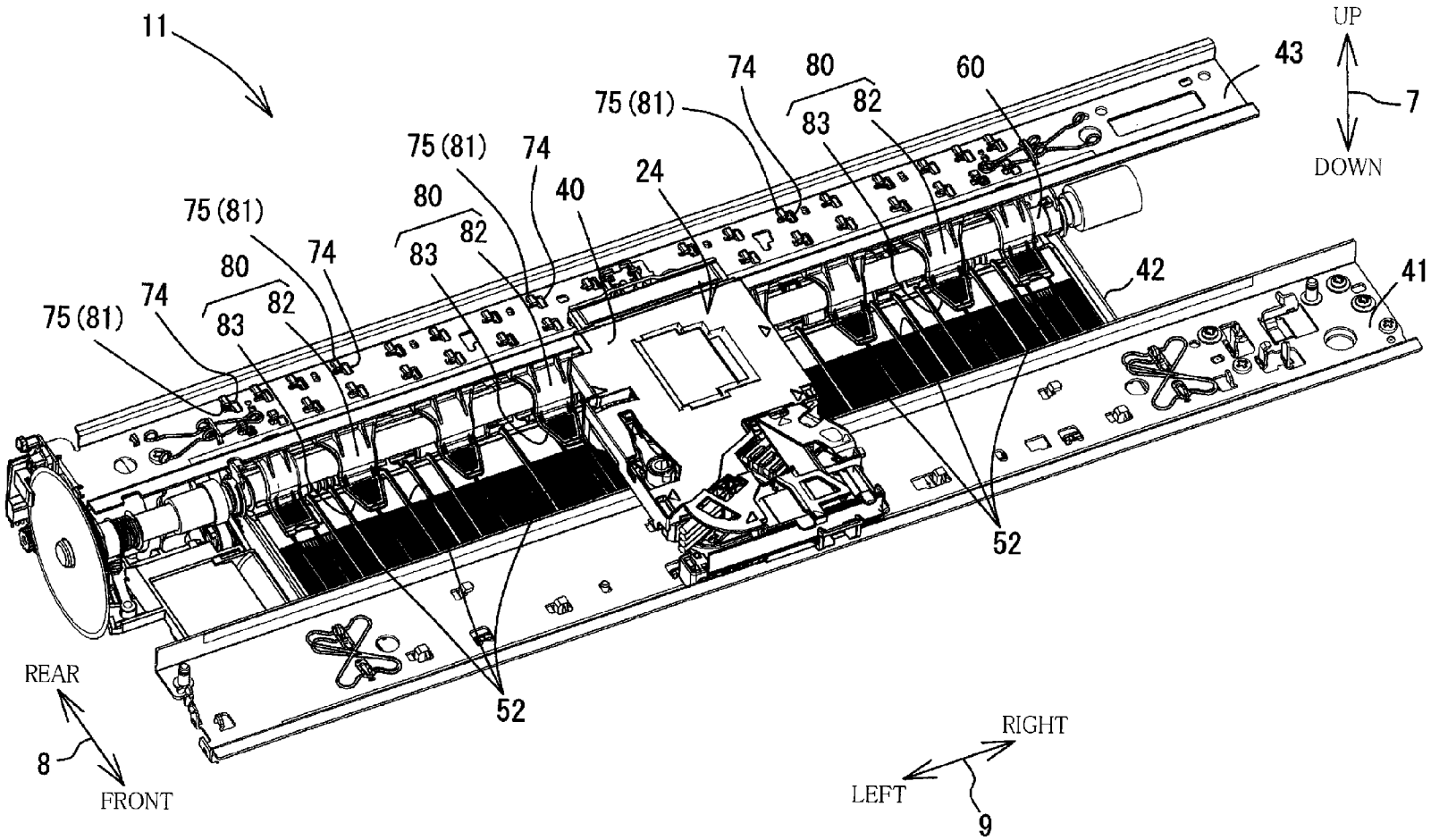
FIG. 6 is a perspective view showing a recording portion, the platen and guide rails.

The recording portion 24 includes a recording head 38 and a carriage 40 which carries the recording head 24. As shown in FIG. 6, the carriage 40 is supported by two guide rails 43, 41 which constitute a part of a frame of the MFD 10 so as to be reciprocateable in a main scanning direction (directions perpendicular to the sheet plane of FIG. 2). Ink is supplied from ink cartridges (not shown) to the recording head 38. While the carriage 40 reciprocates in the main scanning direction, the recording head 38 ejects ink from a plurality of nozzles 39 (shown in FIG. 2) that are formed on a lower surface of the recording head 38. An image is thus recorded on the recording sheet 12, supported by a platen 42 having a generally thin-plate shape and disposed below the feeding path 65 to be opposed to the recording portion 24 and the recording sheet 12 is guided through the feeding path 65.

As shown in FIGS. 3 through 7, on an upper surface of the platen 42, there are formed a plurality of support ribs 52 (an example of a plurality of second support portions) extending upward. Each support rib 52 extends in the front-rear directions 8. To be more specific, each support rib 52 extends in the front-rear directions 8 at least at a position opposite to the nozzles 39. In the present embodiment, each support rib 52 extends rearward from the position opposite to the nozzles 39. In other words, as shown in FIGS. 2 through 6, each support rib 52 extends to a position where a contact portion 83 of a first contact member 80 (described later) is disposed in the front-rear directions 8.

Further, each two of the support ribs 52 adjacent to each other are disposed to be spaced from each other at a certain interval in the left-right directions 9. The recording sheet 12 fed through the feeding path 65 is supported by the support ribs 52 formed on the upper surface of the platen 42.

First Pair of Rollers 58, Second Pair of Rollers 59, and Third Pair of Rollers 44

As shown in FIG. 2, upstream of the recording portion 24 in the first direction 16 in the feeding path 65, there is disposed a first pair of rollers 58 (an example of a first feeding portion). The first pair of rollers 58 consists of a first feeding roller 60 located at an upper position of the feeding path 65 and a first pinch roller 61 located at a lower position of the first feeding roller 60 and located at a lower position of the feeding path 65. The first pinch roller 61 is held in pressure contact with the first feeding roller 60 by an elastic member such as spring, not shown. The first pair of rollers 58 nips the recording sheet 12 supplied by the sheet-supply roller 25 and feeds the same 12 in the first direction 16. Therefore, the recording sheet 12 is fed onto the platen 42.

Figure 3:
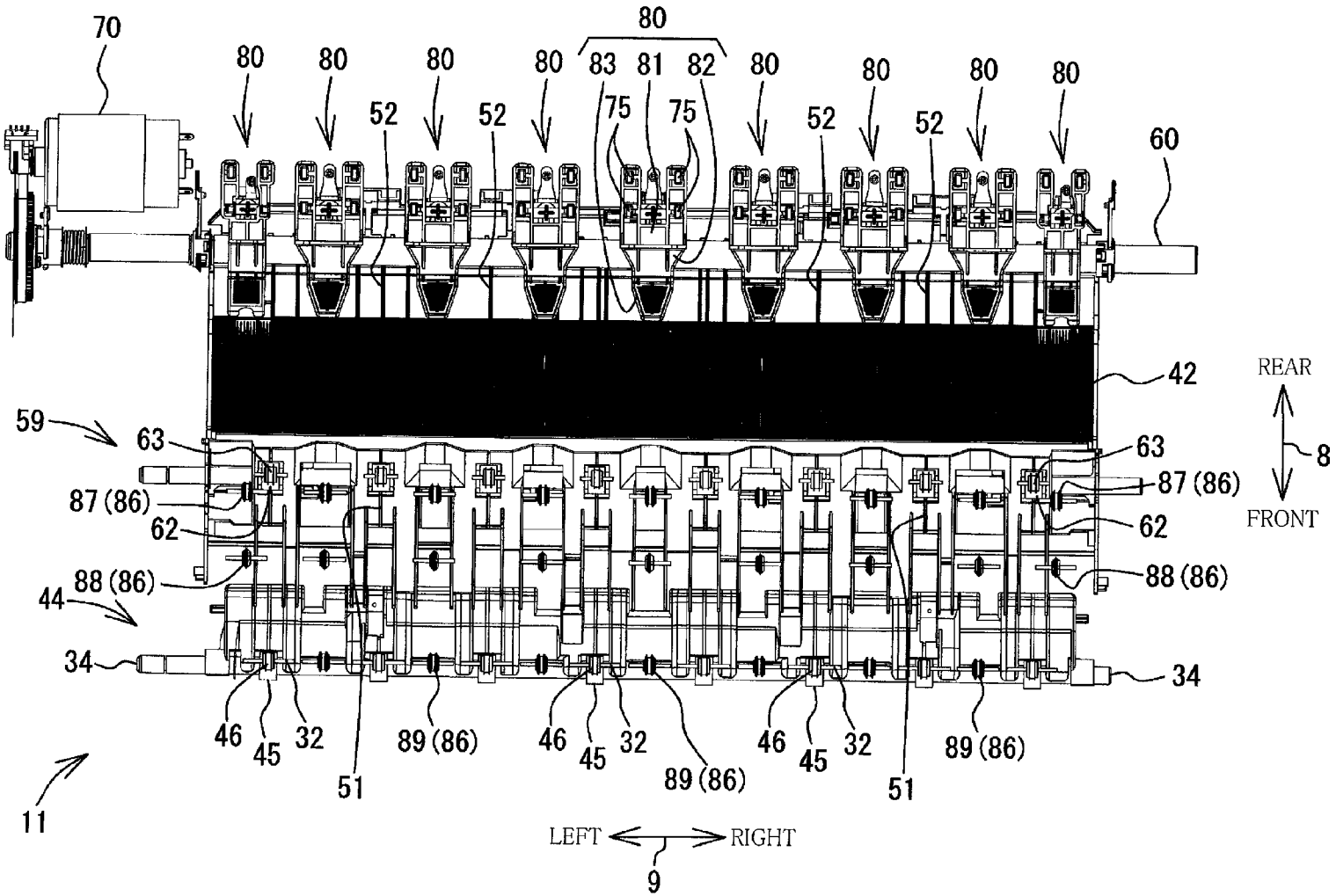
FIG. 3 is a plan view showing a first contact member, a platen and a pair of rollers.
Figure 4:
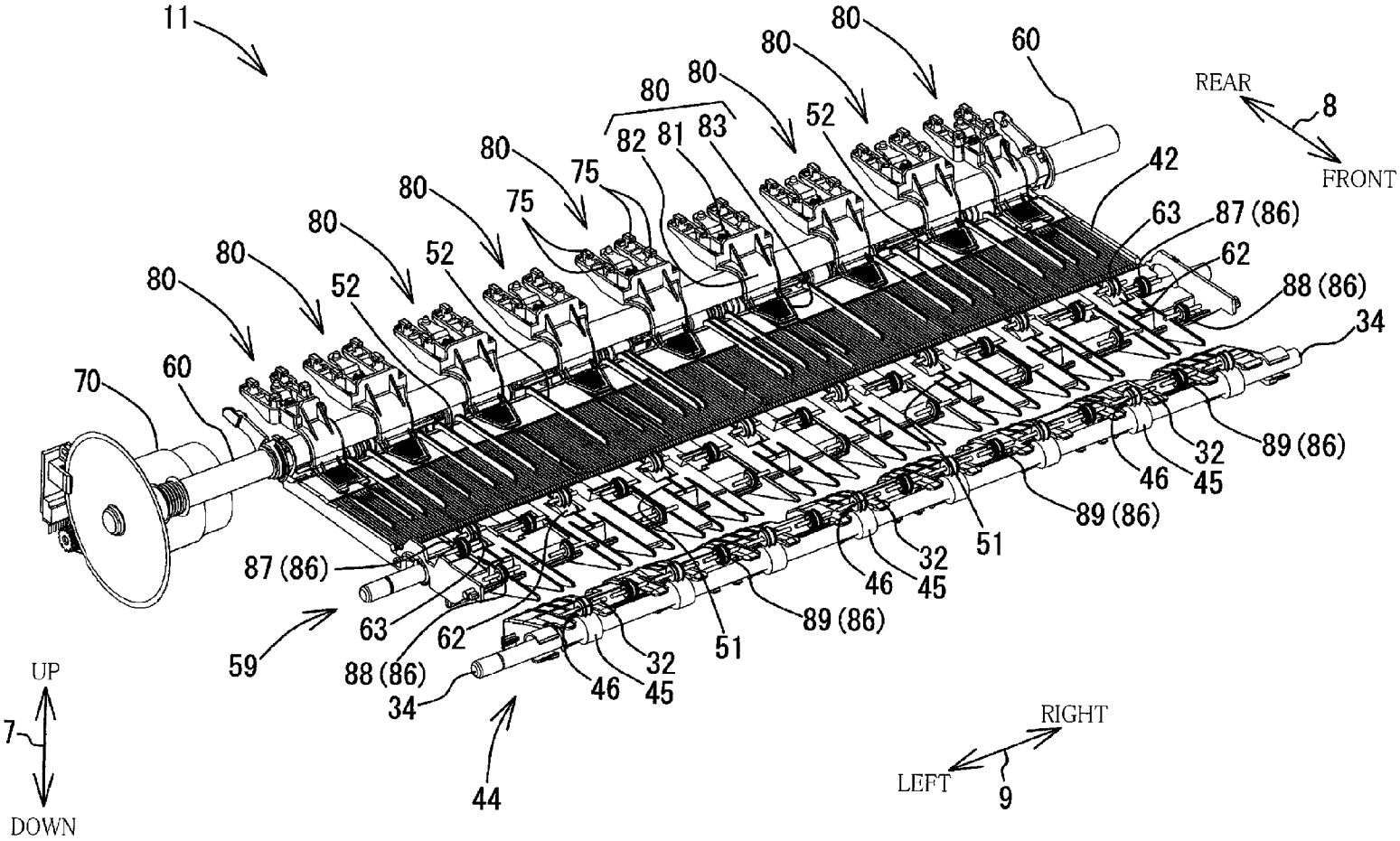
FIG. 4 is a perspective view showing the first contact member, the platen and the pair of rollers.
Figure 5:
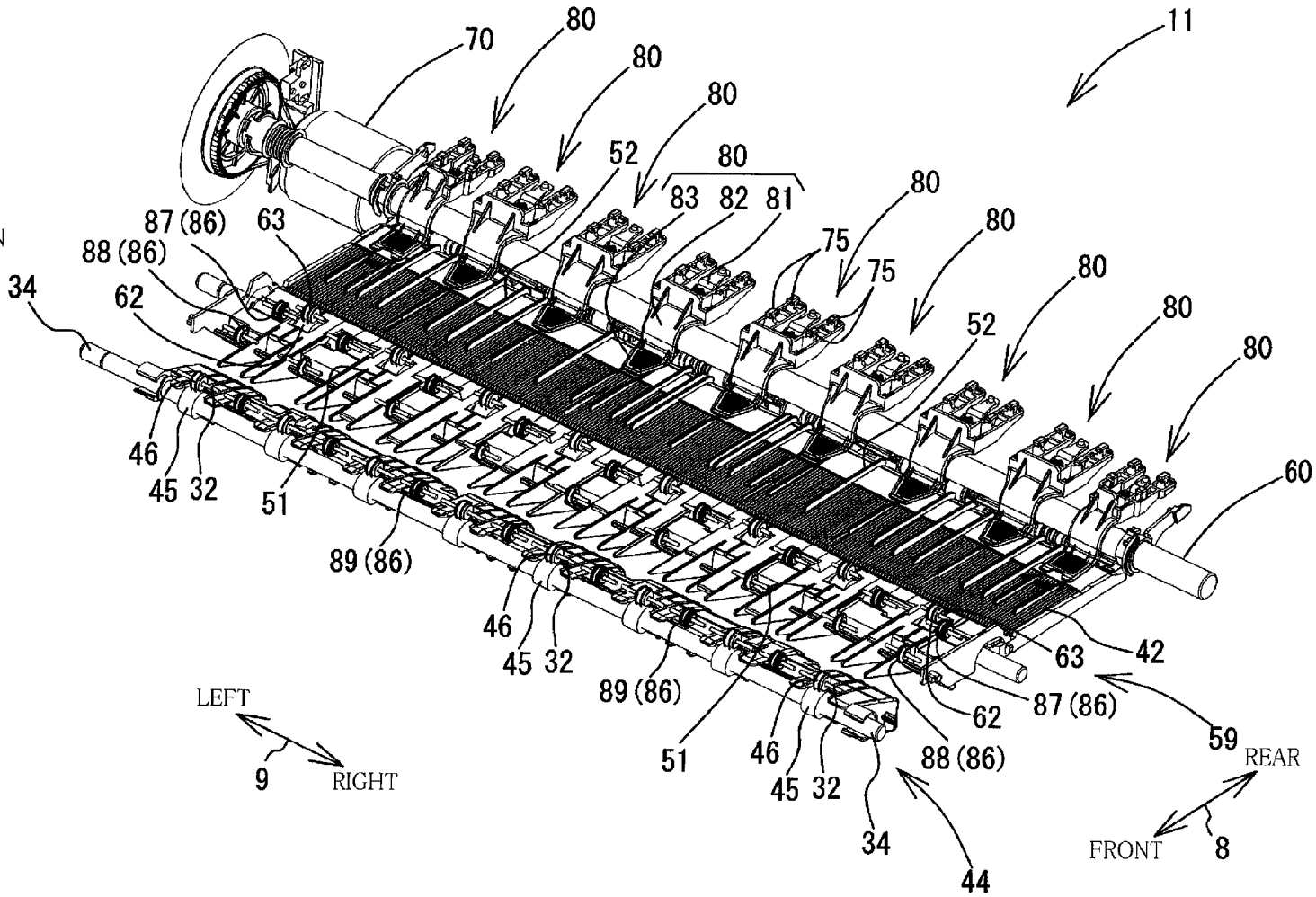
FIG. 5 is a perspective view showing the first contact member, the platen and the pair of rollers.

As shown in FIG. 2, downstream of the recording portion in the first direction 16, there are disposed a plurality of second pairs of rollers 59 (an example of a third feeding portion). Each of the second pairs of rollers 59 consists of a second feeding roller 62 located at the lower position of the feeding path 65 and a spur 63 located at an upper position of the second feeding roller 62 and located at an upper position of the feeding path 65. Similarly to the first pinch roller 61, the spur 63 is held in pressure contact with the second feeding roller 62. As shown in FIGS. 3 through 5, a plurality of spurs 63 are disposed. Each two of the plurality of spurs 63 adjacent to each other are spaced from each other in the left-right directions 9. The second pairs of rollers 59 nip the recording sheet 12 fed from the first pair of rollers 58 and feed the same 12 to the downstream in the first direction 16.

As shown in FIG. 2, downstream of the second pairs of rollers 59 in the first direction 16, there are disposed a plurality of third pairs of rollers 44 (an example of a second feeding portion). Each of the third pairs of rollers 44 consists of a third feeding roller 45 (an example of a lower-position roller) which is located at a lower position of the feeding path 65 and rotated about a shaft 34 and a spur 46 (an example of an upper-position roller) which is located at an upper position of the feeding path 65 to be opposed to the third feeding roller 45 and rotated about a shaft 32. In other words, each of the third pairs of rollers 44 is composed of a pair of an upper-position roller and a lower-position roller. Similarly to the first pinch roller 61, the spur 46 is held in pressure contact with the third feeding roller 45. As shown in FIGS. 3 through 5, a plurality of spurs 46 are disposed. Each two of the plurality of spurs 46 adjacent to each other are spaced from each other in the left-right directions 9. The third pairs of rollers 44 nip the recording sheet 12 fed from the second pairs of rollers 59 and feed the same 12 to the sheet-discharge tray 21 or a second feeding path 67 described later.

As shown in FIG. 2, the shaft 32 of the spur 46 is located upstream of the shaft 34 of the third feeding roller 45 in the first direction 16, i.e., at a rear position of the shaft 34. A positional relation between the third feeding roller 45 and the spur 46 will be described later in more detail. Further, a height 47 of a nipping position of the recording sheet 12 by each of the third pairs of rollers 44 is located at a position higher, or a position upper than a height 48 of a nipping position of the recording sheet 12 by each of the second pairs of rollers 59.

The first feeding roller 60 and the second feeding roller 62 make a forward or a reverse rotation by transmitting of a drive of a feeding motor 70 (shown in FIGS. 3 through 5) in a forward or a reverse rotational direction. For example, when a drive power of the feeding motor 70 in the forward rotational direction is transmitted, the first feeding roller 60 and the second feeding roller 62 are rotated in such a rotational direction that the recording sheet 12 is fed in the first direction 16, on the other hand, when a drive power of the feeding motor 70 in the reverse rotational direction is transmitted, the first feeding roller 60 and the second feeding roller 62 are rotated in such a rotational direction that the recording sheet 12 is fed in a direction opposite to the first direction 16.

The third feeding roller 45, similar to the first feeding roller 60 and the second feeding roller 62, makes a forward or a reverse rotation by transmitting of a drive power of the feeding motor 70 in the forward rotational or the reverse rotational direction. Described in detail, in a case of a one-face printing, the third feeding roller 45 makes the forward rotation. Accordingly, the recording sheet 12 is nipped by the third feeding roller 45 and the spur 46 to be fed to the downstream in the first direction 16 so as to be discharged onto the sheet-discharge tray 21.

On the other hand, in a case of a double-face printing, in a state in which a rear end portion (a trailing end portion) of the recording sheet 12 in the first direction 16 is nipped by the third feeding roller 45 and the spur 46, a rotational direction of the third feeding roller 45 is switched from the forward rotational direction to the reverse rotational direction. Accordingly, the recording sheet 12 is fed in the direction opposite to the first direction 16 so as to be fed toward a reverse feeding path 67 (an example of a second feeding path) described later.

Reverse Feeding Path 67

As shown in FIG. 2, the reverse feeding path 67 is branched from the feeding path 65 at a branched position 36 (an example of a connecting position) located between the second pairs of rollers 59 and the third pairs of rollers 44 in the first direction 16. The reverse feeding path 67 extends obliquely downward and rearward from the branched position 36 (i.e., extends downwards and toward a position where the recording portion 24 is located with respect to the branched position 36). The reverse feeding path 67 also extends below the recording portion 24 and above the sheet-supply roller 25 so as to meet the feeding path 65 at a meeting position 37 located upstream of the first pair of rollers 58 in the first direction 16. In other words, the reverse feeding path 67 is connected to the feeding path 65 at the branched position 36 and the meeting position 37.

The recording sheet 12 is guided through the reverse feeding path 67 in a second direction 17. The second direction 17 is a direction going from the branched position 36 to the meeting position 37 in the reverse feeding path 67 and indicated by a two-dot chain line arrow in FIG. 2.

An upper portion of the reverse feeding path 67 is formed by the inner-position guide member 53. Also, a lower portion of the reverse feeding path 67 is formed by a lower-position guide member 33 (an example of a second lower-position guide member). The inner-position guide member 53 and the lower-position guide member 33 are located to be opposed to each other at such an interval that the recording sheet 12 is allowed to pass. Accordingly, the reverse feeding path 67 is defined by the inner-position guide member 53 (to be more specific, a lower surface 53C of the inner-position guide member 53) and the lower-position guide member 33. The lower surface 53C of the inner-position guide member 53 is an example of a second upper-position guide member.

First Contact Member 80

As shown in FIG. 2, the first contact member 80 is disposed upstream of the nozzles 39 in the feeding path 65 in the first direction 16. As shown in FIGS. 3 through 5, a plurality of (in the present embodiment, nine) first contact members 80 are disposed. Each first contact member 80 has, as shown in FIGS. 2 through 5, an attaching portion 81, a curved portion 82 and the contact portion 83 (an example of a second contact portion).

The attaching portion 81 has a generally flat-plate shape. Each attaching portion 81 is attached to the guide rail 43. More detail will be described as follows. As shown in FIGS. 3 through 5, on an upper surface of each attaching portion 81, a plurality of (in the present embodiment, four) hook portions 75 are formed so as to extend upward. The hook portion 75 is bent rearward at an upper end portion thereof. On the other hand, as shown in FIG. 6, a plurality of openings 74 are formed in the guide rail 43. Each hook portion 75 is inserted into the opening 74 and hooked on a periphery of the opening 74. Accordingly, the upper surface of the each attaching portion 81 is attached to a lower surface of the guide rail 43. Further, each two of the attaching portions 81 adjacent to each other are attached to the guide rail 43 and which are spaced from each other in the left-right directions 9 (an example of a widthwise direction).

As shown in FIGS. 2 through 5, the curved portion 82 extends frontward from the attaching portion 81. The curved portion 82 extends frontward and is curved downward. The contact portion 83 extends frontward from an end portion of the curved portion 82, that is, a front end portion of the curved portion 82. Each two of the curved portions 82 adjacent to each other are, similarly to the attaching portions 81, spaced from each other in the left-right directions 9. Each two of the contact portions 83 adjacent to each other are spaced from each other in the left-right directions 9.

The contact portion 83 has a generally flat-plate shape. The contact portions 83 are located upstream of the nozzles 39 (to be more specific, a rearmost one of the plurality of nozzles 39) of the recording portion 24 in the first direction 16 and at a position opposite to the platen 42. Further, as shown in FIG. 2, the contact portions 83 are disposed downstream of the first pair of rollers 58 in the first direction 16. In other words, the contact portions 83 are located between the recording portion 24 and the first pair of rollers 58 in the feeding path 65.

On a lower surface 84 of the contact portion 83, there is disposed a contact rib 85 (shown in FIG. 7) extending downward from the lower surface 84. A lower end of the contact rib 85 is located at a position lower than the lower surface of the recording head 38 so as to be contactable with an image-recording surface, that is, the upper surface of the recording sheet 12 supported by the platen 42. Accordingly, the recording sheet 12 is pressed downward, that is, the recording sheet 12 is pressed toward the platen 42 by the contact portions 83. The contact portion 83 may have no contact ribs 85. In this case, the lower surface 84 of the contact portion 83 comes into contact with the upper surface of the recording sheet 12. In other words, the lower surface 84 of the contact portion 83 constitutes a lower end of the contact portion 83.

Figure 7:
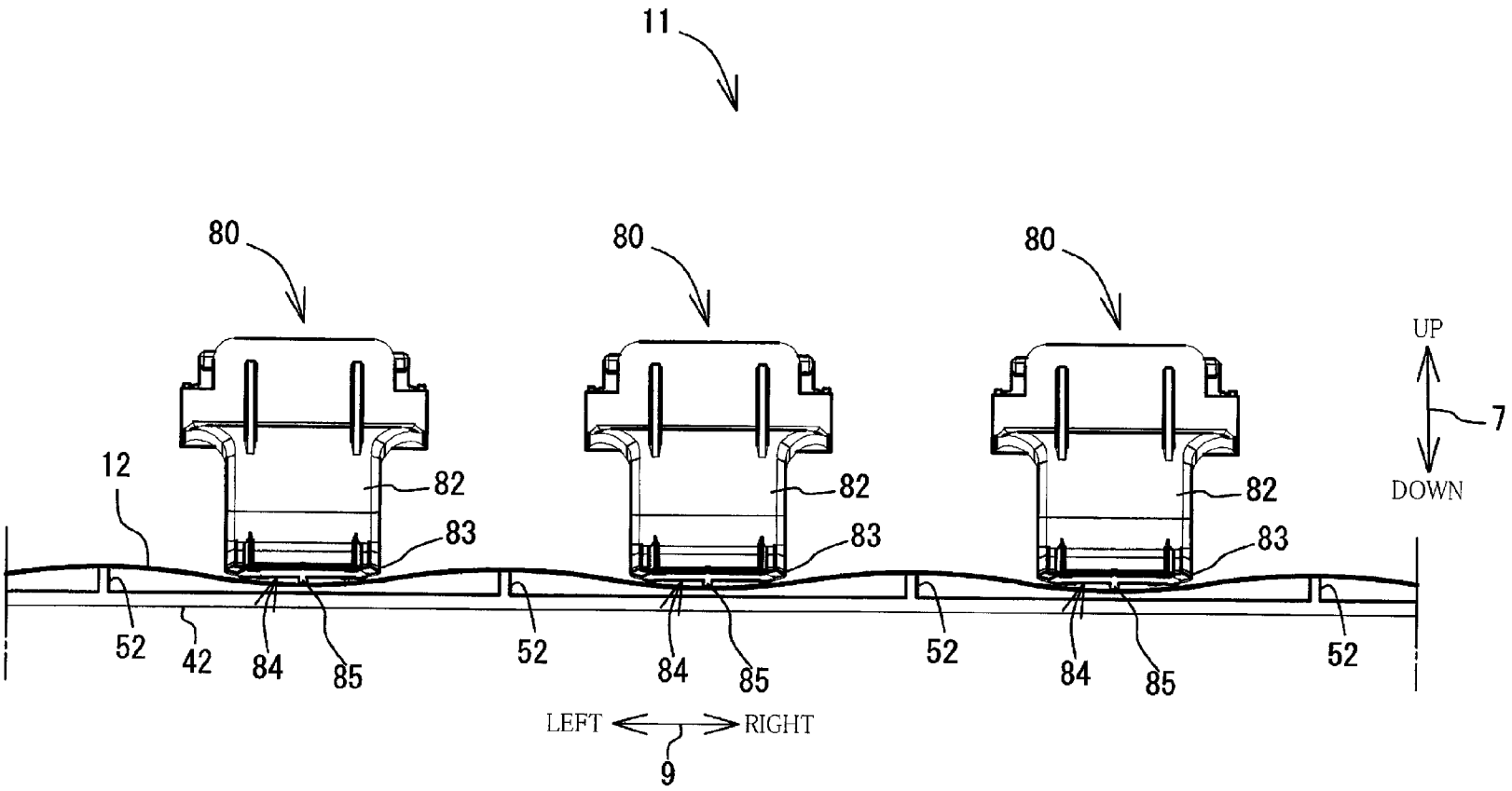
FIG. 7 is a front view showing the platen, the first contact member and a recording sheet.

As shown in FIG. 3, each of the support ribs 52 formed on the platen 42 is located at a position where each of the contact portions 83 is not located in the left-right directions 9. In other words, the contact portions 83 and the support ribs 52 are not opposed to each other in the up-down directions 7. Further, as shown in FIG. 7, each support rib 52 extends to an upper position than the lower end of the contact rib 85 of each contact portion 83. Accordingly, as shown in FIG. 7, the recording sheet 12 being fed in the feeding path 65 is in a state of waving between the platen 42 and the contact portions 83 as seen in its front or rear view.

Second Contact Member 86

As shown in FIGS. 2 through 5, there are disposed a plurality of second contact members 86 between the second pairs of rollers 59 and the third pairs of rollers 44 in the feeding path 65. Here, a position between the second pairs of rollers 59 and the third pairs of rollers 44 in the feeding path 65 includes a position between the second pairs of rollers 59 and the third pairs of rollers 44, the position of the second pairs of rollers 59 and the position of the third pairs of rollers 44 in the front-rear directions 8. In the present embodiment, the second contact member 86 includes a first spur 87 (an example of a first contact portion) which is located in the vicinity of a front position of the second pairs of rollers 59 in the front-rear directions 8, a second spur 88 (another example of the first contact portion) which is located in a middle between the second pairs of rollers 59 and the third pairs of rollers 44 in the front-rear directions 8, and a third spur 89 (an example of a third contact portion) which is located at the same position as the third pairs of rollers 44 in the front-rear directions 8. In the present embodiment, the second contact member 86 includes the first spur 87, the second spur 88 and the third spur 89, but the present invention is not limited to such structure. For example, no first spur 87 and second spur 88 may be disposed in the MFD 10 and the second contact member 86 may consist of the third spur 89 only.

As shown in FIGS. 3 through 5, a plurality of (in the present embodiment, similarly to the first contact member 80, nine) first spurs 87, second spurs 88 and third spurs 89 are respectively disposed in the MFD 10. Each two of the plurality of first spurs 87 adjacent to each other are spaced from each other in the left-right directions 9. Each two of the plurality of second spurs 88 adjacent to each other are spaced from each other in the left-right directions 9. Each two of the plurality of third spurs 89 adjacent to each other are spaced from each other in the left-right directions 9.

Each of the first spurs 87 is located at the same position as each of the first contact members 80 in the left-right directions 9. Each of the second spurs 88 is located at the same position as each of the first contact members 80 in the left-right directions 9. Each of the third spurs 89 is located at the same position as each of the first contact members 80 in the left-right directions 9. The spurs 87, 88, 89 are located in the up-down directions 7 in such a manner that a lower end of each spur 87, 88, 89 is generally the same in height as the lower end of the contact portion 83. Accordingly, each of the lower ends of the spurs 87, 88, 89 is contactable with a corresponding one of bottoms of waves formed on the upper surface of the recording sheet 12 in the state of waving by the contact portions 83.

Further, there are disposed support ribs 51 (an example of a first support portion) between the first spurs 87 and the second spurs 88 in the front-rear directions 8. The support ribs 51 extend in the front-rear directions 8. Each two of the support ribs 51 adjacent to each other are spaced from each other at a certain interval in the left-right directions 9. The recording sheet 12 fed in the feeding path 65 is supported by the support ribs 51. Each support rib 51 extends to an upper position which is upper than the lower ends of the spurs 87, 88. Accordingly, the recording sheet 12 being fed in the feeing path 65 is in a state of waving between the recording portion 24 and the third pair of rollers 44 in its front or rear view.

Furthermore, each of a plurality of third pairs of rollers 44 is disposed between the third spurs 89. Each two of the third pairs of rollers 44 adjacent to each other are spaced from each other at a certain interval in the left-right directions 9. The recording sheet 12 fed in the feeding path 65 is nipped by the third pairs of rollers 44. Nipping positions of the recording sheet 12 by the third pairs of rollers 44 are located higher than the lower ends of the third spurs 89. Accordingly, the recording sheet 12 is in the state of waving at the position where the third pair of rollers 44 are located in the front-rear directions 8 in its front or rear view.

As described above, the recording sheet 12 in the state of waving by the contact portions 83 is prevented from returning to a state in which the recording sheet 12 is in a state of not waving at positions where the second contact members 86 (the first, second, third spurs 87, 88, 89) are located.

In the present embodiment, the plurality of spurs 63 of the second pairs of rollers 59 and the plurality of spurs 46 of the third pairs of rollers 44 are located at positions different from the first contact members 80 in the left-right directions 9. Therefore, as shown in FIGS. 3 through 5, each of the first spurs 87 is located between corresponding two of the spurs 63 of the second pairs of rollers 59, and each of the third spurs 89 is located between corresponding two of the spurs 46 of the third pairs of rollers 44.

Upper-Position Guide Member 54

Figure 8:
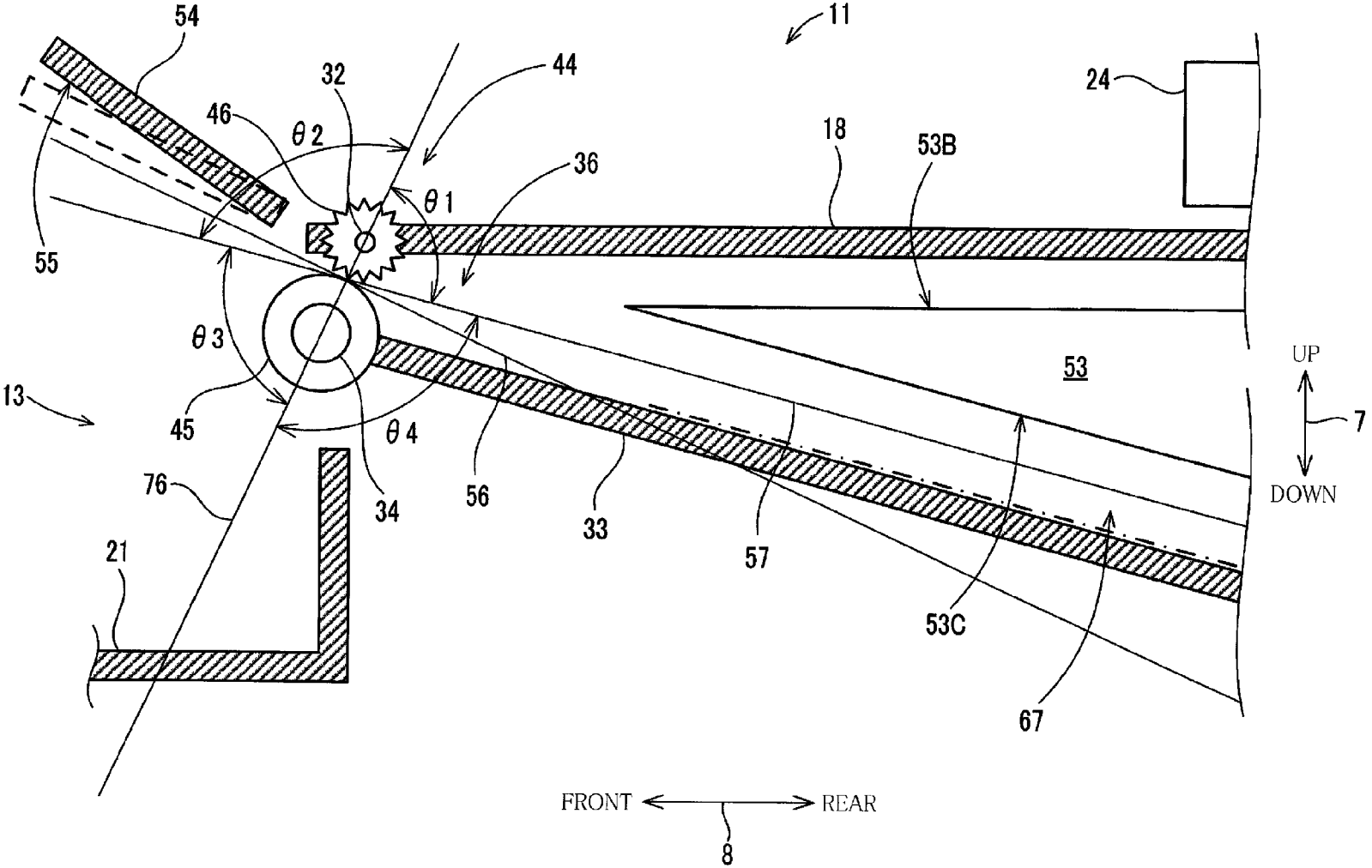
FIG. 8 is a cross-sectional view schematically showing an internal structure of the printer portion in and around a branched position.

As shown in FIGS. 2 and 8, there is disposed an upper-position guide member 54 (an example of a third upper-position guide member) on a front side of the spurs 46 of the third pairs of rollers 44. In other words, the upper-position guide member 54 is located at a position opposite to the recording portion 24 with respect to the third pairs of rollers 44. In FIG. 8, the second pairs of rollers 59 and the second contact members 86 (the first, second, third spurs 87, 88, 89) are omitted. The upper-position guide member 54 extends frontward (to be more specific, obliquely upward and frontward) from the vicinity of front ends of the spurs 46. A front end of the upper-position guide member 54 constitutes an upper end portion of the opening 13. The upper-position guide member 54 also extends in a direction perpendicular to sheet planes of FIGS. 2 and 8, i.e., in the left-right directions 9.

As shown in FIG. 8, a lower surface 55 (an example of a sheet-guide surface) of the upper-position guide member 54 is located at an upper position which is upper than a common tangent plane 56 formed between the third feeding rollers 45 and the spurs 46. The lower surface 55 of the upper-position guide member 54 is contactable with the upper surface of the recording sheet 12 that is fed in the first direction 16 and has passed the third pairs of rollers 44.

Further, when viewed in a direction in which the shaft 32 extends, an amount of a slope of the lower surface 55 of the upper-position guide member 54 is greater than that of the common tangent plane 56. Therefore, a distance (in the up-down directions 7) between the lower surface 55 of the upper-position guide member 54 and the common tangent plane 56 increases as a point on the lower surface 55 moves frontward, i.e., as the point moves apart from the third pairs of rollers 44. As indicated by a broken line in FIG. 8, the lower surface 55 of the upper-position guide member 54 may extend in parallel with the common tangent plane 56.

Positional Relations Between Third Feeding Roller 45 and Spur 46

As mentioned above, the shaft 32 of the spurs 46 is located at a rear position of the shaft 34 of the third feeding rollers 45. Further, as shown in FIG. 2, the shaft 32 of the spurs 46 is located at an upper position of the shaft 34 of the third feeding roller 45. In other words, a first axis, that is an axis of the shaft 32, is located at a rear position of a second axis, that is an axis of the shaft 34. Further, the first axis is located at an upper position of the second axis. In the present embodiment, in addition to the above-mentioned positional relation, the third feeding rollers 45 and the spurs 46 are located at such positions as meeting the following relation. That is, as shown in FIG. 8, a relation in which an angle θ1 is equal to or smaller than 90 degrees. In the present embodiment, the angle θ1 is smaller than 90 degrees.

Hereinafter, the angle θ1 will be described in more detail. The angle θ1 is one of four angles θ1 through θ4 made by an imaginary plane 76 (an example of a first imaginary plane) including the first axis of the shaft 34 of the third feeding rollers 45 and the second axis of the shaft 32 of the spurs 46 and an imaginary plane 57 (an example of a second imaginary plane) extending along the reverse feeding path 67. The angle θ1 equals to the angle θ3, and the angle θ2 equals to the angle θ4. The angle θ1 is one of the four angles that is located at a rear position of the imaginary plane 76 and at an upper position of the imaginary plane 57.

In a case where the third feeding rollers 45 and the spurs 46 are in the above-mentioned positional relation, the recording sheet 12 whose rear end in the first direction 16 is nipped by the third pairs of rollers 44 is in a state in which the recording sheet 12 substantially extends along the common tangent plane 56. In this state, the rear end of the recording sheet 12 in the first direction 16 faces (is close to) the lower-position guide member 33. In this state, when the rotational direction of the third feeding roller 45 is switched from the forward rotational direction to the reverse rotational direction, the recording sheet 12 is fed in the direction opposite to the first direction 16. At this time, the recording sheet 12 is not fed backward in the feeding path 65, but led to the reverse feeding path 67. The reason of this is as follows. That is because, as mentioned above, the rear end of the recording sheet 12 in the first direction 16, i.e., a leading end of the recording sheet 12 in the direction opposite to the first direction 16, faces the lower-position guide member 33 which defines the reverse feeding path 67.

Accordingly, the recording sheet 12 is fed in the second direction 17 through the reverse feeding path 67. In the present embodiment, the leading end of the recording sheet 12 in the second direction 17 which is fed in the reverse feeding path 67, i.e., the rear end of the recording sheet 12 in the first direction 16, is fed in the second direction 17 in a state in which the leading end of the recording sheet 12 is held in contact with the lower-position guide member 33. The reason of this is the same as mentioned above. That is because, as mentioned above, the rear end of the recording sheet 12 in the first direction 16 or the leading end of the recording sheet 12 in the second direction 17 faces the lower-position guide member 33 which defines the reverse feeding path 67.

Effects of the Present Embodiment

In the present embodiment, the third feeding rollers 45 and the spurs 46 are held in contact with each other in a state in which the spurs 46 are located upstream of the third feeding rollers 45 in the first direction 16. When the recording sheet 12 is nipped by the above-mentioned third feeding rollers 45 and the spurs 46, the recording sheet 12 is inclined in such a manner that a downstream portion of the recording sheet 12 in the first direction 16 is located at an upper position than an upstream portion of the recording sheet 12 in the first direction 16, when viewed in the direction in which the shaft 32 extends. Therefore, in a case where the recording sheet 12 is nipped by the third feeding rollers 45 and the spurs 46 in a state in which the rear end of the recording sheet 12 in the first direction 16 is positioned between the branched position 36 and the third pairs of rollers 44, the rear end of the recording sheet 12 comes to face the reverse feeding path 67. Thus, the recording sheet 12 is smoothly led to the reverse feeding path 67. Therefore, in the present embodiment, the recording sheet 12 can be led to the reverse feeding path 67 without a flap or the like for switching paths of the recording sheet 12 in the MFD 10.

Further, in a case where the recording sheet 12 is bent as a whole in the left-right directions 9, the recording sheet 12 apparently has a thickness in the up-down directions 7. In this case, when the recording sheet 12 is led to the reverse feeding path 67 from the branched position 36 of the feeding path 65, it is possible that the recording sheet 12 is caught on the lower surface 53C of the inner-position guide member 53 or the lower-position guide member 33. Therefore, in the present embodiment, the second contact members 86 (the spurs 87, 88, 89) presses down the recording sheet 12. Accordingly, the recording sheet 12 becomes in a state of waving finely in the left-right directions 9, making an apparent thickness of the recording sheet 12 smaller than that of the recording sheet in a case of being bent as a whole. As a result, it can reduce a possibility that the recording sheet 12 is caught on the lower surface 53C of the inner-position guide member 53 or the lower-position guide member 33.

Furthermore, in the present embodiment, in the third pairs of rollers 44, the spurs 46 and the third feeding rollers 45 are held in contact with each other in a state in which the spurs 46 are located upstream of the third feeding rollers 45 in the first direction 16. Therefore, the recording sheet 12 fed in the first direction 16 needs to be inserted into the nipping positions by the third feeding rollers 45 and the spurs 46 from an obliquely rear position. Accordingly, a feeding force necessary for insertion of the recording sheet 12 into the nipping positions is greater than that in a case where the recording sheet 12 is inserted into the nipping positions from a position immediately lateral.

The recording sheet 12 is fed from the first pair of rollers 58 to the third pairs of rollers 44 by a rotation drive power of the first pair of rollers 58. When the leading end of the recording sheet 12 is positioned in the vicinity of the third pairs of rollers 44, which is apart from the first pair of rollers 58, the feeding force by the first pair of rollers 58 is hard to be transmitted to the leading end of the recording sheet 12. Therefore, it is possible that the recording sheet 12 is not inserted into the nipping position.

In the present embodiment, in addition to the second contact members 86 (the spurs 87, 88, 89), the contact portions 83 of the first contact members 80 press down the recording sheet 12. Accordingly, the recording sheet 12 is in a state of waving finely in the left-right directions 9 in an entire area from the first pair of rollers 58 to the third pairs of rollers 44. As a result, the feeding force by the first pair of rollers 58 is easily transmitted to the leading end of the recording sheet 12 such that the recording sheet 12 can be easily inserted into the nipping position.

Further, in the present embodiment, a slope of the recording sheet 12 nipped by the third feeding rollers 45 and the spurs 46 is greater than that of the imaginary plane 57. Therefore, the recording sheet 12 nipped by the third feeding rollers 45 and the spurs 46 is in a state of extending toward the lower-position guide member 33 from a position where the recording sheet 12 is nipped (the nipping positions), i.e., in a state of being distanced from the feeding path 65. As a result, the possibility can be reduced that the recording sheet 12 to be fed to the reverse feeding path 67 is fed backward by accident. In other words, in the present embodiment, the recording sheet 12 can be surely led to the reverse feeding path 67.

As mentioned above, in the case where the recording sheet 12 is nipped by the third feeding rollers 45 and the spurs 46, the recording sheet 12 is inclined in such a manner that the downstream portion of the recording sheet 12 in the first direction 16 is located at an upper position than the upstream portion thereof in the first direction 16, when viewed in the direction in which the shaft 32 extends. In this case, the recording sheet 12 nipped by the third feeding rollers 45 and the spurs 46 is, on the opposite position of the recording portion 24 with respect to the third pairs of rollers 44, in a state of extending obliquely upward from the position where the recording sheet 12 is nipped. When the above-described recording sheet 12 comes into contact with a frame constituting a top panel inside the MFD 10, the recording sheet 12 may be jammed in the MFD 10. In the present embodiment, the lower surface 54 of the upper-position guide member 54 that is highly likely to come into contact with the recording sheet 12 extends obliquely upward from the third pairs of rollers 44. Therefore, the recording sheet 12 is less likely to come into contact with the upper-position guide member 54 and be jammed in the MFD 10.

Further, as mentioned above, the recording sheet 12 fed in the first direction 16 needs to be inserted into the nipping positions by the third feeding rollers 45 and the spurs 46 from the obliquely rear position. In the present embodiment, the height 47 of the nipping positions of the recording sheet 12 by the third pairs of rollers 44 is located at a position higher than the height 48 of the nipping positions of the recording sheet 12 by the second pairs of rollers 59. Accordingly, the leading end of the recording sheet 12 in the first direction 16 that has passed the second pairs of rollers 59 can be easily nipped by the third pairs of rollers 44.

What is claimed is:

1. An image recording apparatus comprising:

a first upper-position guide member and a first lower-position guide member opposed to each other and defining a first feeding path;

a first feeding portion configured to feed a sheet in a feeding direction along the first feeding path;

a recording portion located downstream of the first feeding portion in the feeding direction and configured to record an image on the sheet fed in the first feeding path;

a second upper-position guide member and a second lower-position guide member opposed to each other and defining a second feeding path which is connected to the first feeding path at a downstream position of the recording portion in the feeding direction and extends obliquely downward from a connecting position where the second feeding path connects to the first feeding path so as to pass below the recording portion; and a second feeding portion comprising at least one pair of rollers each consisting of an upper-position roller and a lower-position roller which is located downstream of the connecting position in the feeding direction, wherein the second feeding portion is configured to feed the sheet along the second feeding path, and a first axis of the upper-position roller is located upstream of a second axis of the lower-position roller in the feeding direction;

wherein the at least one pair of rollers is disposed such that, among four angles made by a first imaginary plane including the first axis and the second axis and a second imaginary plane extending along the second feeding path when viewed in a direction in which the first axis extends, one angle made by one of opposite faces of the first imaginary plane closer to the recording portion and one of opposite faces of the second imaginary plane closer to the recording portion is equal to or smaller than 90 degrees.

2. The image recording apparatus according to claim 1, wherein the at least one pair of rollers is disposed such that the first axis of the upper-position roller is located at a position higher than the second axis of the lower-position roller.

3. The image recording apparatus according to claim 1, further comprising a third feeding portion located at a portion between the recording portion and the connecting position in the first feeding path, the third feeding portion comprising at least one pair of rollers each consisting of an upper-position roller and a lower-position roller and being configured to feed the sheet, and wherein a nipping position of the sheet by the second feeding portion is located at a position higher than a nipping position of the sheet by the third feeding portion.

4. An image recording apparatus comprising:

a first upper-position guide member and a first lower-position guide member opposed to each other and defining a first feeding path;

a first feeding portion configured to feed a sheet in a feeding direction along the first feeding path;

a recording portion located downstream of the first feeding portion in the feeding direction and configured to record an image on the sheet fed in the first feeding path;

a second upper-position guide member and a second lower-position guide member opposed to each other and defining a second feeding path which is connected to the first feeding path at a downstream position of the recording portion in the feeding direction and extends obliquely downward from a connecting position where the second feeding path connects to the first feeding path so as to pass below the recording portion;

a second feeding portion comprising at least one pair of rollers each consisting of an upper-position roller and a lower-position roller which is located downstream of the connecting position in the feeding direction, wherein the second feeding portion is configured to feed the sheet along the second feeding path, and a first axis of the upper-position roller is located upstream of a second axis of the lower-position roller in the feeding direction; and a third upper-position guide member located at a position opposite to a position where the recording portion is disposed with respect to the second feeding portion and at a position higher than an imaginary tangent plane touching a roller surface of the upper-position roller and a roller surface of the lower-position roller, the third upper-position guide member including a sheet-guide surface configured to be contactable with an upper surface of the sheet which has passed the second feeding portion, wherein the sheet-guide surface is parallel to the imaginary tangent plane or extends in such a manner that a point on the sheet-guide surface moves away from the imaginary tangent plane as the point moves away from the at least one second feeding portion.

5. The image recording apparatus according to claim 4, wherein the at least one pair of rollers is disposed such that the first axis of the upper-position roller is located at a position higher than the second axis of the lower-position roller.

6. The image recording apparatus according to claim 4, further comprising a third feeding portion located at a portion between the recording portion and the connecting position in the first feeding path, the third feeding portion comprising at least one pair of rollers each consisting of an upper-position roller and a lower-position roller and being configured to feed the sheet, wherein a nipping position of the sheet by the second feeding portion is located at a position higher than a nipping position of the sheet by the third feeding portion.

* * * * *